United States Patent [19]

Olschewski et al.

[11] 4,449,421

[45] May 22, 1984

[54] LEVER MECHANISM WITH PROGRESSIVE TRANSMISSION

[75] Inventors: Armin Olschewski; Zoltan Laszlofalvi; Heinrich Kunkel, all of Schweinfurt, Fed. Rep. of Germany

[73] Assignee: SKF Kugellagerfabriken GmbH, Schweinfurt, Fed. Rep. of Germany

[21] Appl. No.: 343,231

[22] Filed: Jan. 27, 1982

[30] Foreign Application Priority Data

Feb. 7, 1981 [DE] Fed. Rep. of Germany ..... 31042635

[51] Int. Cl.[3] ..... G05G 1/04

[52] U.S. Cl. ..... 74/516; 74/520; 74/110; 100/272; 72/450

[58] Field of Search ..... 74/520, 516, 518, 110; 100/272, 283, 286; 72/450, 451

[56] References Cited

U.S. PATENT DOCUMENTS

| | | | |
|---|---|---|---|
| 3,540,524 | 11/1970 | Bacheuer | 100/272 |
| 3,738,748 | 3/1973 | Hecht | 74/110 |

FOREIGN PATENT DOCUMENTS

| | | | |
|---|---|---|---|
| 100600 | 12/1964 | Denmark | 100/286 |
| 137710 | 1/1903 | Fed. Rep. of Germany | 72/450 |
| 2840151 | 6/1979 | Fed. Rep. of Germany | 100/283 |
| 673609 | 10/1929 | France | 74/518 |
| 626980 | 8/1978 | U.S.S.R. | 100/283 |

*Primary Examiner*—Allan D. Herrmann
*Assistant Examiner*—Anthony W. Raskob
*Attorney, Agent, or Firm*—Eugene E. Renz, Jr.

[57] ABSTRACT

Lever mechanism with progressive transmission for increasing the force in presses and the like consisting of a retaining plate fastened to the ram of the machine, a movable mechanism component connected with the retaining plate and a support plate for a stationary mechanism component, comprising a lever yoke (6) with fulcrum points (7, 8, 11) arranged in a generally triangular array, one of said fulcrum points being pivotally to the movable mechanism component (3) by means of an equilibration link (9), the second fulcrum point (7) being pivotally connected to the retaining plate (2) and the third fulcrum point (11) being pivotally connected to the support plate (4) by means of another equilibrium link (12).

6 Claims, 4 Drawing Figures

$RS_1 < TT_1$

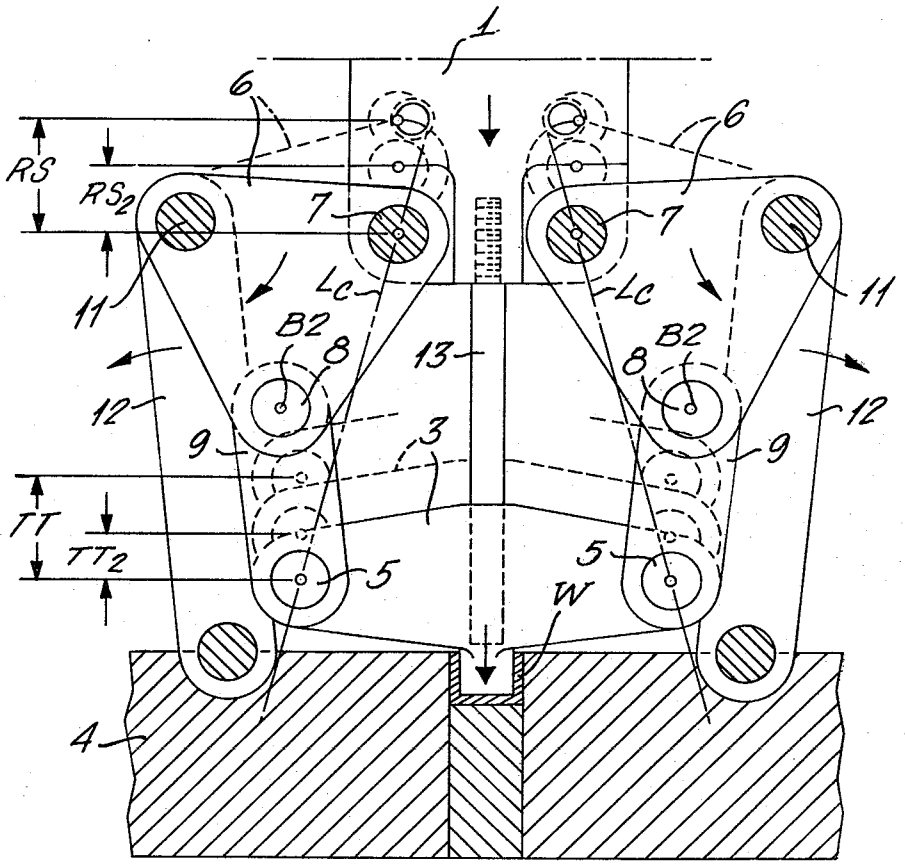
$RS_2 > TT_2$
$\Sigma RS = RS_1 + RS_2$ , $\Sigma TT = TT_1 + TT_2$
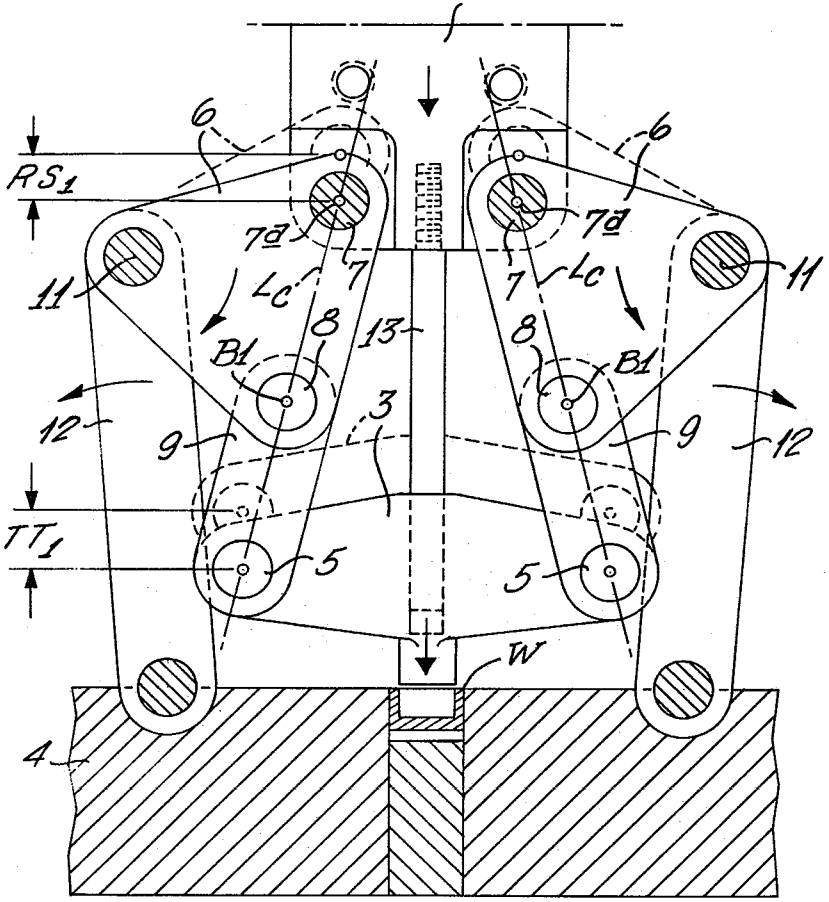
$RS_1 < TT_1$

LEVER MECHANISM WITH PROGRESSIVE TRANSMISSION

BACKGROUND AND SUMMARY OF THE INVENTION

The present invention relates to lever mechanisms particularly adapted for use in presses and the like which is characterized by nobel features of construction and arrangement providing progressive transmission of increased delivery force in the operation of the press.

Conventional presses for punching, embossing or deep drawing and the like generally comprise a main frame including a base which supports a die or stationary mechanism component and a ram adapted for reciprocating movement which mounts a tool or movable mechanism component and cooperates with the die to punch, emboss or deep draw a work piece to form a product. The ram and base plate typically mount means or devices for supporting exchangeable tools and dies. The efficiency of the press is limited among other things by the maximum pressing force and the stroke. Usually for economical reasons, the press or machine needed by a given industry is oftentimes purchased with respect to their efficiency according to the current production of the industry. However, it has been found that products are often developed which cannot be processed any longer on the available press or machine devices by reason of the fact that the product requirements exceed the technical specifications of the press. Usually the limiting factor is the available pressing force.

With the foregoing in mind, it is an object of the present invention to provide a lever mechanism as an auxilliary or add-on device for presses which has the capability of increasing the pressing force without necessitating large structural changes in the press itself or substantially shortening the stroke of the ram. To this end, the lever mechanism comprises a generally triangular lever yoke with fulcrums provided adjacent the corners of the triangle, one of which is pivotally connected with the movable mechanism component by means of an equilibrium arm or link, the second is pivotally connected with the retaining plate and the third is pivotally connected with the support plate by means of another equilibrium arm or link.

By this lever mechanism, there is provided an increase in the pressing force which operates according to the laws of leverage. For example, the pressing force initiation takes place from the ram via the attached retaining plate to one of the corner fulcrums of the lever yoke. Since the second corner fulcrum of the lever yoke is connected with the support plate by means of an eqilibrium or balancing arm or link, the third fulcrum pivots about the second and displaces the movable mechanism component by means of the equilibrium link. Thus during the conforming stroke movement of the ram, there is a continuous changing of the lever ratios and this constantly changing lever ratio of the lever system results in different transmission ratios for the distance covered by the movable mechanism component. This advantageously results in transmission of a pressing force as a function of the position of the movable mechanism, which as a result of changing the lever ratios may be selected in such a way that a very great force increase only occurs during the actual pressing or forming of the work piece; that is, in the latter part of the ram stroke range. Thus, while the movable mechanism component is moving or guided toward the work piece, almost no force is required so that this step can be completed more rapidly. For this reason, the lever ratios can be selected in such a way that the movable mechanism component compared to the ram covers a larger distance in this range. Stroke loss as a result of force increasing during the initial operating phase of the mechanism components is advantageously compensated for in this way by the extension of the stroke when guiding the movable mechanism component to the work piece. Depending on the design of the lever system, the maximum stroke of the ram provided by the press is only slightly shortened although the lever mechanism provides a manifold pressing force increase.

In accordance with another feature of the invention, the support plate for the stationary mechanism component, that is the die, may be constructed separately from the frame and secured thereto. The reason for this is that oftentimes the stability of the press frame is not sufficient and thereby requires reinforcement by suitable measures. One arrangement is to provide a separate plate meeting the requirements for the support of the stationary mechanism component. The second corner fulcrum of the lever yoke is fastened to this plate by means of the equilibrium or balancing arm. The support plate itself is anchored in a detachable fashion on the press frame by screw fasteners or bolts. The pressing force gained by the lever mechanism according to the present invention is thereby transmitted as tensile force by means of the equilibrium arm to the separate support plate and, therefore, obviates overstressing of the press frame.

In the preferred embodiment of the invention, at least two lever systems disposed symmetrically to the axis of the mechanism components are provided. By reason of this balanced arrangement, there is a meaningful distribution of the forces so that the individual fulcrums of each system only have to transmit a corresponding portion of the total force and, therefore, may be constructed accordingly. A further advantage is that with a uniform arrangement of several lever systems about the axis of the tools, there is a good and accurate guiding of the movable tool mechanism.

In accordance with a further feature of the present invention, axial guide means extending in the direction of movement of the ram is provided. Thus, in applications wherein the two mechanism components, that is, the punch and die, must cooperate very accurately with equidistant axes, for example, in punching, the lever mechanism is provided with an additional axial guide for the movable mechanism component. A slide pin can be installed in the extension of the ram, for example, on which the movable mechanism component can slide in an axial direction. By this arrangement, the levers only have the function of force transmission.

In accordance with still a further feature of the invention, the retaining plate, support plate, the two mechanism components, the lever yokes and the equilibrium may form a unitary assembly which may be assembled and disassembled from the press as an integral unit very easily and economically. This facilitates installation in the press with a minimum of equipment and manipulations. The force ratios are selectively adjusted to the two mechanism components and to the work piece to be produced and accordingly an optimized lever mechanism can be provided as an exchange component.

BRIEF DESCRIPTION OF THE DRAWINGS

These and other objects of the present invention and the various features and details of the operation and construction thereof are hereinafter more fully set forth with reference to the accompanying drawings, wherein:

FIG. 1*a* is a view similar to FIG. 1 showing the lever mechanism in a midway position;

FIG. 1*b* is a view similar to FIGS. 1 and 1*a* showing the lever mechanism at the end of the second phase of its stroke for maximum force increase.

DESCRIPTION OF THE PREFERRED EMBODIMENT

Figure 1:
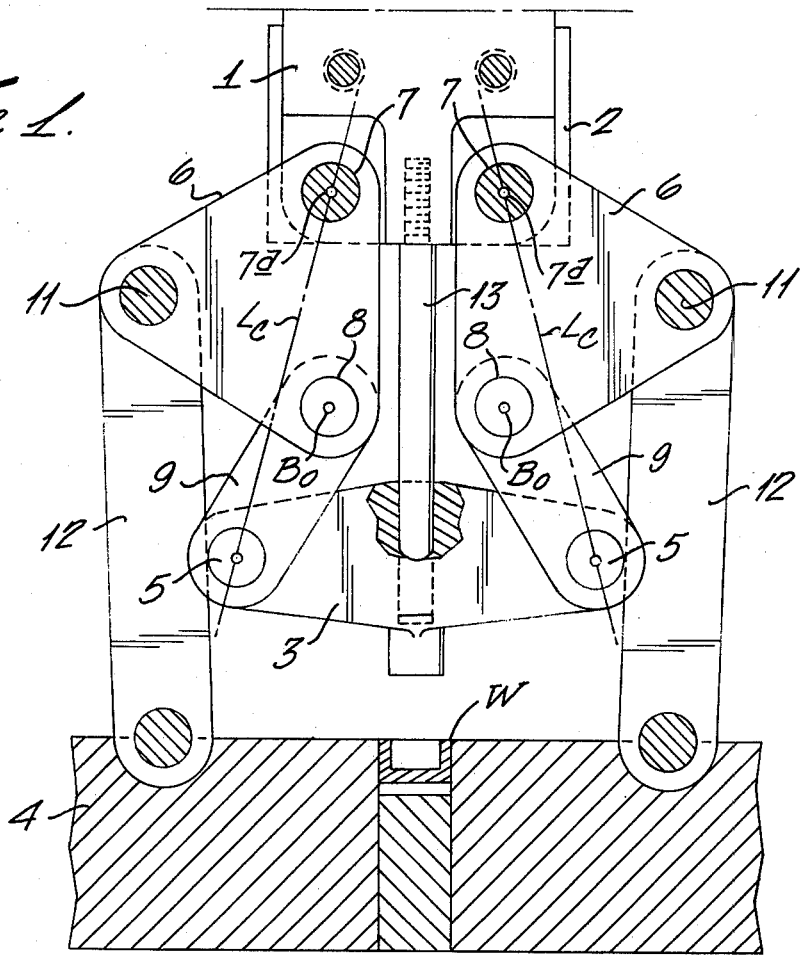
FIG. 1 is a view showing a two lever mechanism system in accordance with the present invention, in the present instance a two-lever system showing the ram in a raised position.

Referring now to the drawings and particularly to FIGS. 1–1*b* thereof, the essential components of a lever mechanism in accordance with the present invention are shown. The lever mechanism is adapted to be mounted interchangeably in a conventional press which includes a ram 1 mounted for reciprocating axial movement and which mounts a movable mechanism component such as a tool and a frame including a base plate to which the support plate 4 may be secured and which in turn includes a pocket or recess for the stationary mechanism component such as the die. As illustrated, two lever systems of identical construction and arrangement are disposed symmetrically relative to the axis of the stationary and movable mechanism components. In FIG. 1, the components of the lever mechanism and the ram are shown in a starting position phase and in FIG. 1*b* the ram is lowered to form the work piece.

The lever mechanism comprises essentially the retaining plate 2, the movable mechanism component 3, a support plate 4 and the two lever systems 6, 9 and 12. Considering now the mechanism more specifically, the retaining plate 2 has two opposing fulcrums 7 which form the supports of two identical lever yokes 6 by means of pivot bolts 7*a*. The lever yokes are generally of triangular configuration defining fulcrum pivots 7, 8 and 11 at each of its corners. The inward corner fulcrum 7 is pivotally connected to the retaining plate 2. The lower corner fulcrum 8 is pivotally connected to the movable tool mechanism 3 by means of an equilibrium link 9 and the outward corner fulcrum is pivotally connected to the support plate 4 by means of a second equilibrium or balancing arm 12. The equilibrium arms 9 and 12 function to equalize the horizontal displacement of the corner fulcrums 8 and 11 when the lever yokes are pivoted about their inward fulcrum 7. This action can be clearly seen by comparing FIGS. 1–1*b*. The support plate 4 is adapted to be firmly secured to the frame of the press and supports a stationary mechanism component such as a die which is not shown in detail. Retaining plate 2 is firmly secured to the forward end of the ram of the press and in the present instance the ram has an axial extension in the form of a slide pin 13 on which the movable tool component 3 is axially guided.

Consider now broadly operation of a press incorporating a lever mechanism of the present invention and assume the maximum delivery force of the ram 1 is F. As the ram is moved downwardly, the levers 6 rotate outwardly and the pivot 8 is displaced angularly from its position inwardly of the center line $L_c$ passing through the pivot points 7 and 5 toward the center line $L_c$. During this portion of the stroke, the delivery force of the ram is less than and approaching F and is equal to F when it lies on the center line $L_c$. (See FIG. 1*a*). During this first range or phase for a given linear displacement $RS_1$ of the ram 1, the lever action produces a larger linear displacement $TT_1$ of the tool 3. As the pivot 8 rotates outwardly from the center line $L_c$, there is a converse result, that is, the delivery force of the ram to the tool exceeds F and increases progressively and the linear displacement $TT_2$ of the tool 3 is less than a corresponding linear displacement $RS_2$ of the ram during the second range.

Considering now more specifically operation of the press and assuming movement of the ram from its starting position (FIG. 1) to a work engaging or forming position (FIG. 1*b*) the downward movement of ram 1 is transmitted to the inward corner fulcrum 7 of the lever yokes 6 via the retaining plate 2. This produces outward pivotal movement of the levers 6, since the outer corner fulcrums 11 are connected with the fixed support plate by means of the equilibrium links 12 and their position in the direction of the pressing force is fixed and cannot change. Note that during this pivoting action, the corner fulcrums 8 of the lever yokes 6 pivot about the outward corner fulcrums 11. Consequently, an additional axial travel of the movable mechanism component 3 relative to the retaining plate 2 takes place via the equilibrium links 9. This travel is vectorially added to the ram travel. In the starting position lever yoke 6 is as shown in FIG. 1. When ram 1 is lowered, fulcrum 8 travels in a path shown as dotted lines on FIGS. 1*a* and 1*b*. As lever yoke 6 rotates about fulcrum 7 and fulcrum 8 moves from position $B_0$ to $B_1$ and the distance $TT_1$ travelled by movable mechanism component 3 is greater than ram 1 travel but the force exerted by ram 1 on movable mechanism component 3 is reduced. When fulcrum 8 reaches $B_1$ the travel and force ratios are 1:1. As fulcrum 8 rotates beyond $B_1$ toward $B_2$, movable mechanism component 3 travel with respect to ram 1 travel is decreasing while movable mechanism component force with respect to ram 1 force is increasing.

During a further lowering of the ram 1, the lower corner fulcrum 8 of the lever yoke 6 moves in an arc outwardly from the connecting line $L_c$. As a result, the distance of the movable tool component 3 relative to the retaining plate 2 becomes steadily smaller. This movement in this phase counteracts the downward movement of the ram 1 as a result of which the movable tool component 3 covers a smaller distance $TT_2$ than the ram 1 $RS_2$ (see FIG. 1*b*). According to the law of leverage, the pressing force affecting the movable tool component 3 in this partial range of the ram stroke is greater than the maximum pressing force F of the ram 1 and increases steadily as the pivot 3 moves further outwardly from the center line $L_c$ so that the greatest pressing force delivered to the tool 3 occurs during the work forming portion of the ram stroke.

Stated another way, the stroke loss occurring as a result of the increase in pressing force in the second range or phase is compensated by an increased stroke relative to the ram 1 in the first partial range so that the total maximum stroke of the press is practically maintained.

Figure 2:
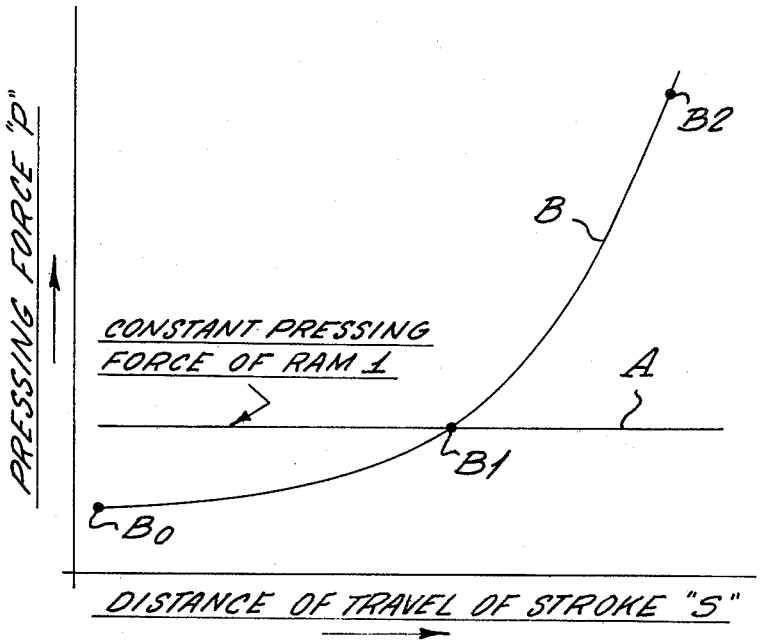
FIG. 2 is a pressing force-stroke diagram.

FIG.2 shows two superimposed curves. For the sake of clarity, curve A assumes a pressing force of the press constant over the entire stroke s of the ram 1. Curve B shows the force-vs-ram stroke obtained when the lever mechanism of the present invention is installed. In the first partial range up to point B1, a reduced pressing force results while in the second partial range up to the bottom return point B2 of the ram 1, the pressing force steadily increases.

In summary the lever mechanism of the present invention permits easy and economical modifications of conventional presses to progressively increase the delivery force of the ram and thereby increase the capacity of the press. The lever mechanism thereby expands the capability of the press to perform pressing or forming operations beyond its rated capabilities. Further the lever mechanism produces a variable or non-uniform displacement of the tool for a predetermined uniform or constant ram stroke and therefore the point of maximum delivery force of the tool can be controlled without modifying ram stroke. This may be advantageous in combined operations such as drawing and embossing wherein the initial drawing requires comparatively small tool force and the final embossing stroke requires a greater force.

The described and shown embodiment is an example of the lever mechanism according to the invention. It is, however, always possible to adapt to any appropriate application by changing the lever ratios and shapes.

What is claimed is:

1. A lever system for increasing the force in a press having a movable platen (3), a ram (1) operable to produce a predetermined force, and a support platen (4) for a workpiece, comprising:

a first connecting rod (12), pivotally connected at one end to said support platen (4);

a second connecting rod (9), pivotally connected at one end to said movable platen (3); and a lever yoke (6) having three non-aligned fulcrum points (7, 8, 11) in a triangular array, pivotally connected at a first fulcrum point (7) to said ram and defining a center line between said first fulcrum point and the pivotal connection (5) between said second connecting rod and said movable platen, said yoke also being pivotally connected at a second fulcrum point (8) to said second connecting rod (9) and spaced from the pivotal connection of said second connecting rod (9) to said movable platen (3), and pivotally connected at a third fulcrum point (11) to said first connecting rod and spaced from the pivotal connection of said first connecting rod to said support platen (4), said second fulcrum point (18) being movable across said center line in response to movement of said ram toward said support platen (4), whereby as said second fulcrum point moves across said center line and said third fulcrum point (11) moves away from said center line, the force delivered by said lever system to said movable platen increases progressively relative to the predetermined force of said ram.

2. A lever system according to claim 1, characterized in that the support platen (4) is constructed separate from the frame of the press.

3. A lever system according to claim 1 characterized in that at least two lever systems, (6, 9, 12) are arranged symmetrically to the axis of the mechanism components.

4. A lever system according to claim 1, including an axial guide (13) extending in the direction of the ram (1) for the movable platen (3).

5. A lever system according to claim 1, characterized in the support platen (4), the two movable platens (3), the lever yokes (6) and the connecting rods (9, 12) form an exchangeable unit.

6. A lever system according to claim 1 wherein the force exerted by the ram on the movable component is less than said predetermined force when said second fulcrum point (8) is located inwardly of said center line.

* * * * *